US009200862B1

(12) United States Patent
Turner et al.

(10) Patent No.: US 9,200,862 B1
(45) Date of Patent: Dec. 1, 2015

(54) PROJECTILE LAUNCHING WRISTBAND SLINGSHOT

(71) Applicants: Dallas Turner, Tallahassee, FL (US); Jeff Phipps, Tallahassee, FL (US); Jeff Mitchell, Tallahassee, FL (US)

(72) Inventors: Dallas Turner, Tallahassee, FL (US); Jeff Phipps, Tallahassee, FL (US); Jeff Mitchell, Tallahassee, FL (US)

( * ) Notice: Subject to any disclaimer, the term of this patent is extended or adjusted under 35 U.S.C. 154(b) by 0 days.

(21) Appl. No.: 14/299,110

(22) Filed: Oct. 20, 2014

(51) Int. Cl.

| | |
|---|---|
| ***F41B 3/02*** | (2006.01) |
| ***F41B 3/00*** | (2006.01) |
| ***A44C 5/00*** | (2006.01) |
| ***A44B 17/00*** | (2006.01) |
| ***A63H 33/18*** | (2006.01) |

(52) U.S. Cl.
CPC ..... *F41B 3/02* (2013.01); *A44B 17/0023* (2013.01); *A44C 5/0007* (2013.01); *A44C 5/0053* (2013.01); *A63H 33/18* (2013.01); *F41B 3/00* (2013.01)

(58) Field of Classification Search
CPC .... F41B 3/02; A44C 5/0007; A44B 17/0023; A63H 33/18
USPC ..... 124/16, 17, 20.1, 35.1, 1; 24/16 PB; 2/170; 63/3; 446/486
See application file for complete search history.

(56) References Cited

U.S. PATENT DOCUMENTS

| | | | | | |
|---|---|---|---|---|---|
| 1,434,312 | A * | 10/1922 | Penney | B65D 9/38 | 217/91 |
| 1,776,435 | A * | 9/1930 | Isbell | F41B 3/00 | 124/20.1 |
| 1,945,932 | A * | 2/1934 | Caley | A45D 2/18 | 132/247 |
| 2,324,201 | A * | 7/1943 | Donaldson | F41B 3/02 | 124/16 |
| 2,367,249 | A * | 1/1945 | Walker | F41B 3/02 | 124/17 |
| 2,443,408 | A * | 6/1948 | Walker | F41B 3/02 | 124/20.1 |
| 2,585,663 | A * | 2/1952 | Laubly | F41B 3/02 | 124/16 |
| 2,996,060 | A * | 8/1961 | Appleby | F41B 3/02 | 124/20.1 |
| 4,098,441 | A * | 7/1978 | Campbell | F41C 33/002 | 224/150 |

(Continued)

*Primary Examiner* — Alexander Niconovich
(74) *Attorney, Agent, or Firm* — J. Wiley Horton

(57) ABSTRACT

A wristband slingshot that can be used to launch projectiles. The invention preferably has two holes on either end designed to fit a user's fingers. The finger holes are used to stretch the device between two of the user's fingers so a projectile can be launched from the center, which has an increased area—acting as a pouch. The center section with increased area, or pouch, preferably contains grooves and a hole in the center in order to grip and center a projectile. While the main function of the current invention is to act as a projectile launcher, it is designed to have multiple functions. The device preferably comprises a clasping mechanism that is integrated into finger holes already contained in the device.

14 Claims, 12 Drawing Sheets

(56) References Cited

U.S. PATENT DOCUMENTS 4,569,324 A * 2/1986 Garcia ..... B21F 1/002 124/20.1
4,873,964 A * 10/1989 Bonoan ..... A63B 65/12 124/20.1
5,127,389 A * 7/1992 Magnuson ..... F41B 3/02 124/17
5,154,515 A * 10/1992 Haynes ..... F41B 3/02 124/17
5,190,021 A * 3/1993 Hull ..... F41B 3/02 124/17
5,274,927 A * 1/1994 Arnt ..... F41B 5/14 124/88
5,277,169 A * 1/1994 Magnuson ..... F41B 3/02 124/1
5,996,565 A * 12/1999 Whitmer ..... A63B 65/12 124/17
6,189,543 B1 * 2/2001 Sonstegard ..... A45D 8/00 132/246
6,276,029 B1 * 8/2001 Buettell ..... A44C 5/0007 24/16 PB
6,401,726 B1 * 6/2002 Sonstegard ..... A45D 2/40 132/246
6,679,498 B2 * 1/2004 Barniak, Jr. ..... A63B 21/0552 273/317.3
7,337,786 B2 * 3/2008 Sonstegard ..... A45D 8/12 132/273
7,900,620 B1 * 3/2011 Walters ..... F41B 3/02 124/20.1
8,087,404 B2 * 1/2012 Saunders ..... F41B 3/02 124/20.1
8,210,405 B1 * 7/2012 Pritchard ..... F41C 33/002 224/150
8,850,675 B2 * 10/2014 Frydlewski ..... A63B 3/0078 24/300
8,925,535 B2 * 1/2015 Phillips ..... F41B 3/02 124/20.1
9,022,012 B2 * 5/2015 Loetz ..... A63F 9/0278 124/18
2007/0193567 A1 * 8/2007 D'Acquisto ..... F41B 5/0026 124/23.1
2008/0210211 A1 * 9/2008 Madsen ..... F41B 5/14 124/88
2009/0183299 A1 * 7/2009 Conway ..... A44C 5/0007 2/170
2011/0139201 A1 * 6/2011 Haddad ..... A45B 3/00 135/76
2013/0081602 A1 * 4/2013 Pedersen ..... A63H 33/18 124/17
2015/0181983 A1 * 7/2015 Fox ..... A43C 19/00 132/200

* cited by examiner

PROJECTILE LAUNCHING WRISTBAND SLINGSHOT

BACKGROUND OF THE INVENTION

1. Field of the Invention

This invention relates to the field of projectile launchers. More specifically, the invention comprises a projectile launcher intended to be used with the fingers that doubles as a clasping, wearable wristband.

2. Description of the Related Art

While camping or hiking, space is nearly always at a premium. Backpackers and campers are constantly seeking ways to reduce the size and weight of essential gear. This is especially true for minimalist hikers and hikers travelling long distances. Thus, a device that occupies a small amount of space and/or combines multiple functions is attractive to those seeking to reduce weight and space while camping or hiking.

It is common for an individual who is camping or hiking to hunt for his or her food while in the wilderness. Many different methods can be used, but typically, a camper hunts in a very simple manner. In addition, it is customary for children to participate in games that involve weapons. Both hunting and children's games often involve the use of a projectile launching device. Projectile launching devices are popular because one can use such a device to launch a multitude of objects at different targets.

One of the most common examples of a projectile launching device is a slingshot. A typical slingshot comprises a base that leads into a fork containing two members. An elastic band (or similar component) is attached to each of the two members of the fork. A pouch is attached to the other end of each of the elastic bands. The user grasps the base with one hand, leaving one hand free to load and pull back the pouch, stretching the elastic band. The user can then aim and fire a projectile at a target.

While effective, a typical slingshot configuration requires carrying the base and fork assembly. When the user is not using the slingshot, he or she must find a place to stow the slingshot, such as a backpack, book bag, or hiking pack. In the event the user is suddenly caught in a game where a slingshot is required (such as an ambush in a war-type game often played among children) or the opportunity arises where a hiker needs his or her slingshot immediately (for example, the sighting of an animal to be hunted), pulling a slingshot from one's bag puts the user at a disadvantage.

The prior art discloses some renditions of a slingshot. One such configuration is disclosed in U.S. Pat. No. 5,127,389 to Magnuson. This prior art slingshot is designed to be used by two people or using one's foot in addition to the user's hands. For use with a single person, the user pulls the pouch that contains the projectile back with his or her foot while holding the two ends of the device with the hands. When two people use the device, there are multiple configurations that can be used. The most apparent is having each person grab one hand grip, then use one of the users' free hands to grasp the launching pouch. This is larger and more cumbersome than the typical forked version, making it even more difficult to operate and stow.

In U.S. Pat. No. 5,277,169 from Magnuson, a catching component is added to the previous invention. A mitt is attached to one of the hand grips, which allows the user to catch a fuzzy ball or similar projectile that is launched using the projectile launcher disclosed in U.S. Pat. No. 5,127,389. If two users have one of the inventions each, it is possible for the users to play catch using the mitt and fuzzy balls.

While the prior art has shown that there is an interest in the field of projectile launchers, the prior art has failed to provide a projectile launcher that can be stowed on the body of the user when not in use. The current invention solves this and other problems, as described in detail in the following text.

BRIEF SUMMARY OF THE PRESENT INVENTION

The current invention comprises a projectile launcher that can be used to launch a multitude of objects. The invention preferably has two holes on either end designed to fit a user's fingers. The finger holes are used to stretch the device between two of the user's fingers so a projectile can be launched from the center. In a preferred embodiment, the invention is constructed from a flexible material so that it may be stretched in a fashion similar to that of a typical slingshot, which is stretched between two members of a fork. In addition, the invention consists of an increase in area in the center of the band. The increased area creates a pouch that allows the device to accommodate numerous projectiles. Maintaining a smaller area adjacent to the finger holes and increased area region allows the invention to be stretched more easily. The center section with increased area, or pouch, preferably contains grooves and a hole in the center in order to grip and center a projectile.

While the main function of the current invention is to act as a projectile launcher, it is designed to have multiple functions. This is especially true for a hiking/camping application where a multi-purpose wristband is extremely useful. These functions relate mainly to fishing and hunting, but vary due to the versatility of the invention. Possible applications are described in detail in the subsequent text.

In addition, the present invention acts as a wristband. The device preferably comprises a clasping mechanism that is integrated into finger holes already contained in the device. Preferably, one of the finger holes contains a protruded end with an outer diameter that fits into the other finger hole that does not have a protruded end. To clasp the device the protruded end can be inserted into the other end of the device that has no protrusion. When the invention is clasped, small buttons, containing accessories that are useful while a user is camping or hiking, can be placed in the finger holes. The contents of the buttons are discussed further in the subsequent text. Preferably, the material the invention is constructed from is flexible, which allows for this to occur. When the projectile launching aspect of the device is ready to be used, the user simply unclasps the invention.

REFERENCE NUMERALS IN THE DRAWINGS

| | | | |
|---|---|---|---|
| 10 | slingshot | 12 | pouch |
| 14 | band | 16 | base |
| 18 | fork | 19 | cusp |
| 20 | wristband slingshot | 22 | ridge |
| 24 | finger hole | 26 | protruded region |
| 28 | pouch center hole | | |
| 30 | protruded region outer diameter, $d_p$ | | |
| 32 | receiving end finger hole inner diameter, $d_r$ | | |
| 34 | clasping mechanism | 36 | receiving end |
| 38 | protruded end | 40 | user's arm |
| 42 | user's hand | 44 | user's thumb |
| 46 | user's index finger | 48 | projectile |
| 50 | pulling force | 52 | spear fishing device |
| 54 | spear | 56 | guide |
| 58 | knob | 60 | stick |
| 62 | button | | |

DETAILED DESCRIPTION OF THE INVENTION

The present invention provides a wristband slingshot that has a main function of launching projectiles with the fingers. The wristband slingshot has additional features described further in the subsequent text. The current invention preferably contains all the main components of a typical slingshot. Although the current invention, or wristband slingshot, does contain a base, band, fork and pouch, the configuration is different from a common slingshot found in the prior art. The similarities and differences are described further in the following text.

Figure 1:
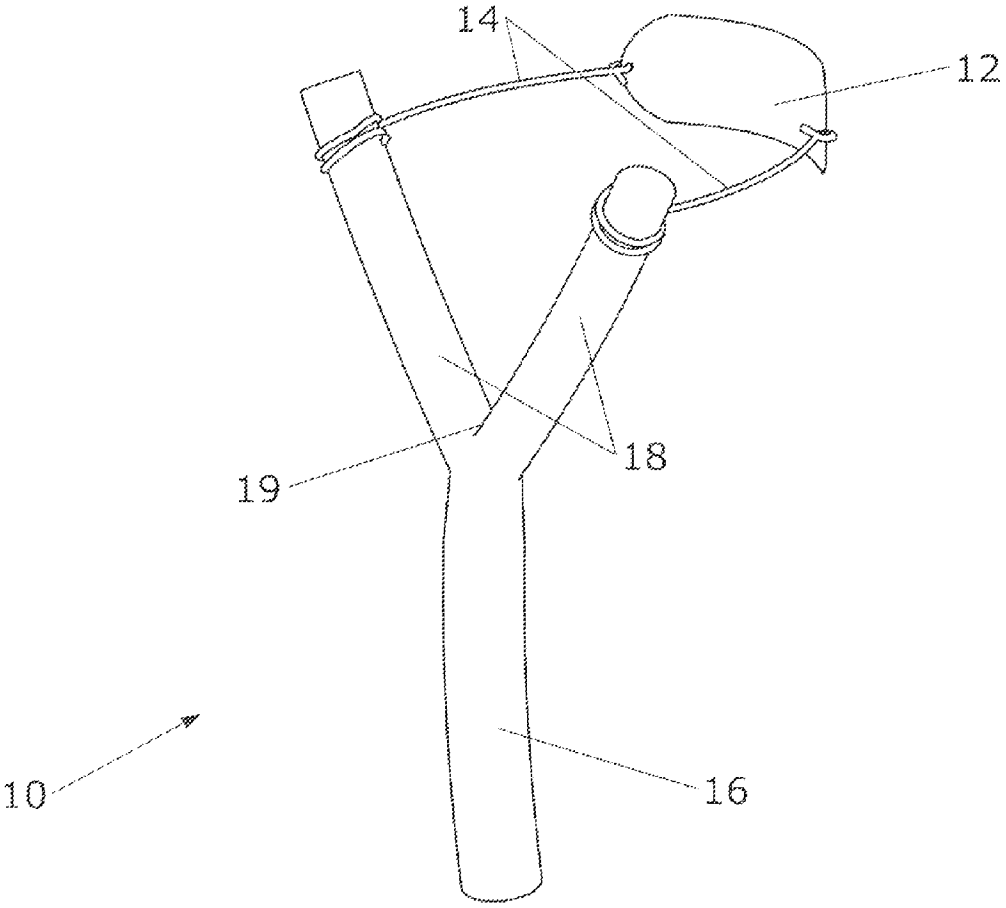
FIG. 1 (PRIOR ART)
FIG. 1 is a perspective view, showing a prior art slingshot.

The slingshot shown in FIG. 1 is a common prior art slingshot 10 comprising, pouch 12, band 14, and base 16. Base 16 contains fork 18, which has two members. Those members preferably protrude from the base within the same 2-dimensional plane. To explain further, if the reader were looking at slingshot 10 in FIG. 1 from a side view, he or she would only be capable of seeing the fork member directly in front. The second member would be completely hidden because the two members exist in the same plane. This is not an issue when slingshot 10 is manufactured. However, if one were to use a forked stick to create base 16, the preferred stick would have a fork that is as "flat" as possible.

The two members of fork 18 are separated by an angle. The preferred angle ranges from 60 to 100 degrees. If the angle is too large (greater than 100 degrees), then the user will have trouble launching a projectile due to interference with the fork and base. The interference will come at a position near cusp 19 where the two members of the fork meet. Here the extreme case is if the angle between the two members of fork 18 is 180 degrees—band 14 would lie across the members of fork 18. If the angle between the two members of the fork is too small (less than 60 degrees), the user may encounter interference of the projectile or the user's fingers with the members of the fork.

A typical prior art slingshot may consist of one or two bands 14. If there is only one band 14, then it is fastened to each member of fork 18. In this scenario, pouch 12 is attached to the center of the single band 14. If the slingshot consists of two bands 14, one band 14 is attached to one member of fork 18 and the other band 14 is attached to the other member of fork 18. Each unattached end of the two bands 14 are attached to each end of pouch 12 (the bands are not attached to the same end of the pouch). The number of bands is determined by the method from which the slingshot is manufactured and the preference of the individual who designed the slingshot.

A projectile can be placed into pouch 12. Once the projectile is set, the user pulls pouch 12 away from base 16 and fork 18. This action stretches band 14. The amount band 14 is stretched determines the velocity and distance the projectile travels. The elasticity of the band and strength of the user determine the distance the band can be stretched. These are considerations made when designing a slingshot.

There are multiple configurations of a prior art slingshot available, but every slingshot contains three main components (described in the preceding text): a base, pouch and band. For example, a slingshot with a fork in the shape of a "U" instead of a "V" ("V" shape shown in FIG. 1) would eliminate the angle restriction presented in the preceding text. However, the manufacturer would be required to allow a sufficient distance between the members to accommodate the loading of the projectile and the user's hand.

Figure 2:
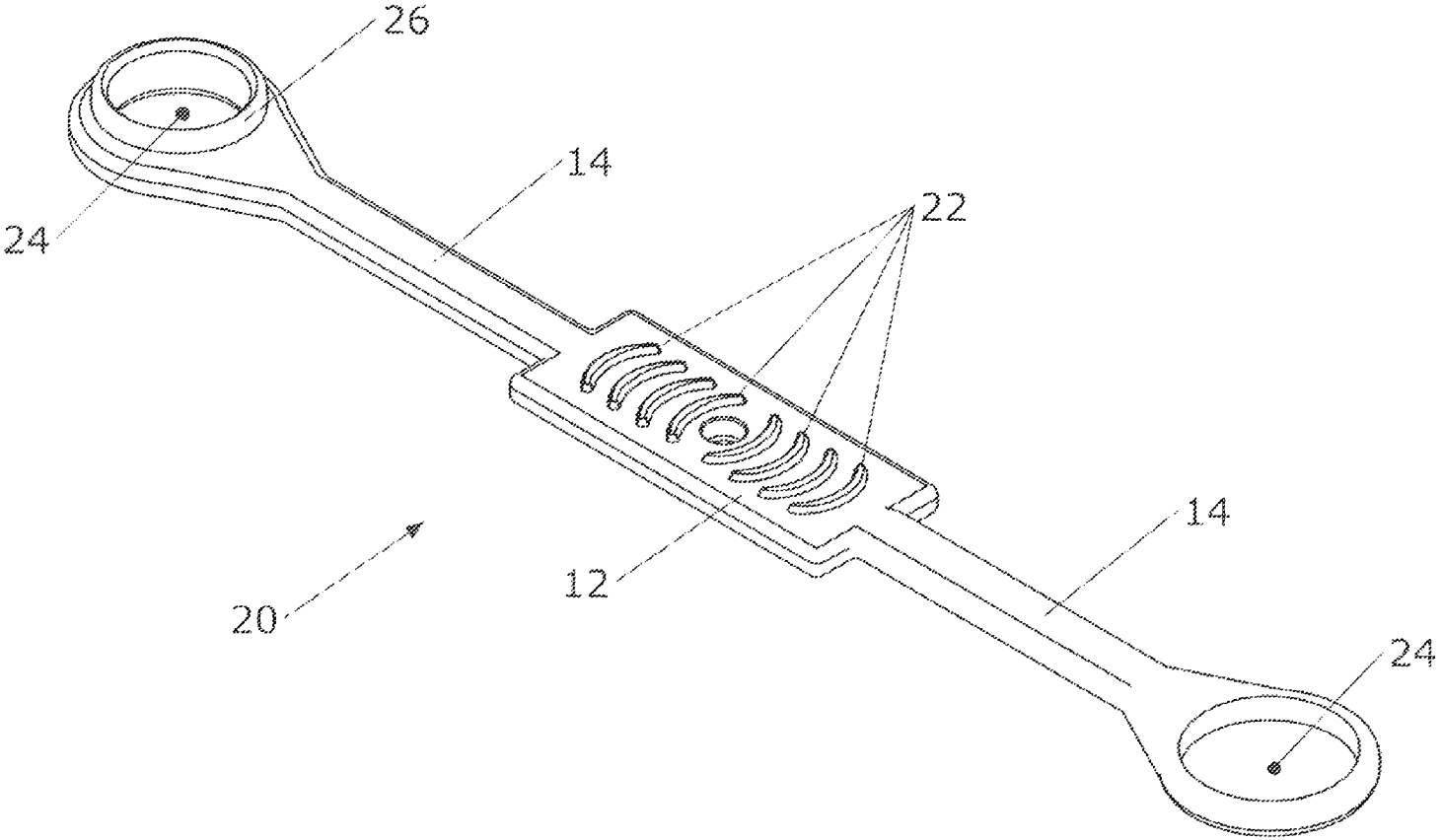
FIG. 2 is a perspective view, showing a preferred embodiment of the present invention.
Figure 3:
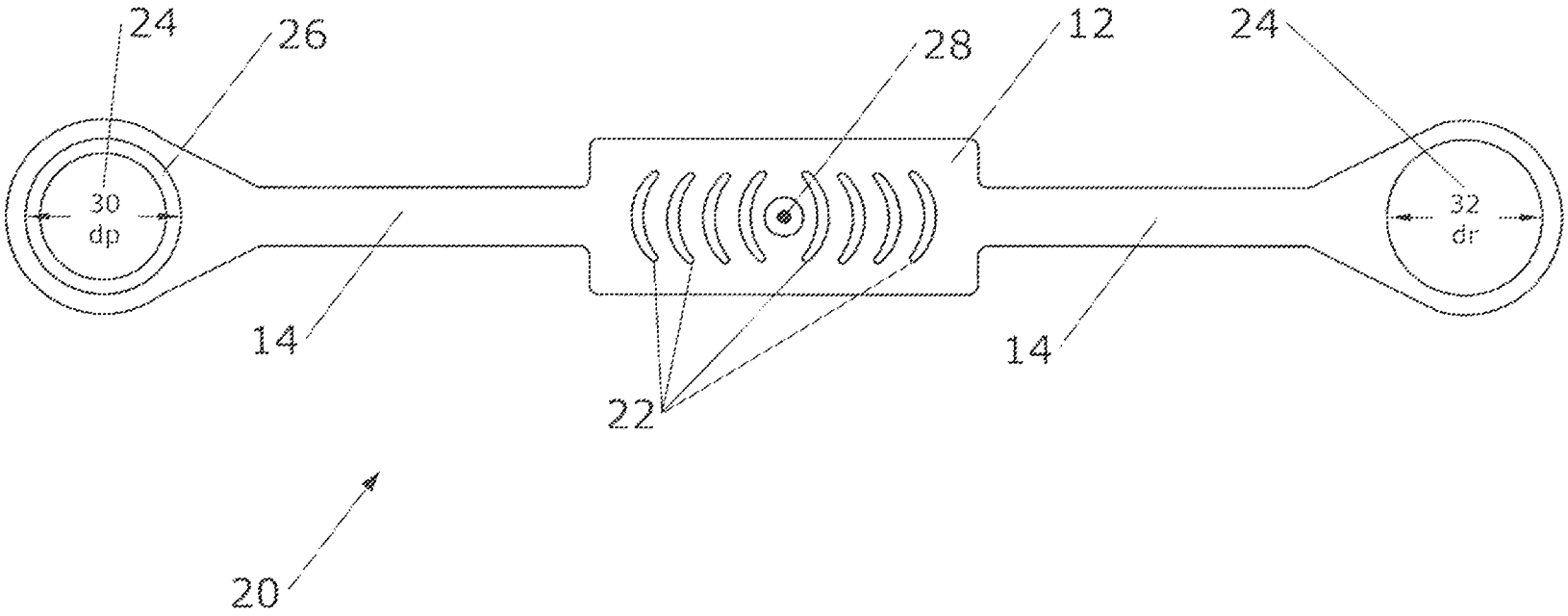
FIG. 3 is an elevation view, showing a comparison of the diameters of the finger holes.

FIG. 2 shows a preferred embodiment of the current invention. The present invention, or wristband slingshot, is shown in an open state for the clasping mechanism. Although wristband slingshot 20 appears to be rigid in FIGS. 2-3, it is preferably fabricated from a soft material. The views shown in FIGS. 2-3 are helpful in demonstrating the elements of the invention despite the rigid appearance. The main components of any slingshot demonstrated in FIG. 1 are present in wristband slingshot 20. While all the necessary components of a slingshot are accounted for, some components of projectile launching wristband slingshot 20 are of a different form than a typical prior art slingshot demonstrated by the following explanation.

Similar to a common prior art slingshot, wristband slingshot 20 comprises pouch 12 and band 14. In the case of wristband slingshot 20, pouch 12 and band 14 are a single piece. As FIG. 2 shows, pouch 12 has an increased cross sectional area in the direction orthogonal to the length of wristband slingshot 10, but the two components are a single part. Typically, the pouch and bands are separate components; however, it is not uncommon for prior art slingshots to combine the two elements. A slingshot, such as the one demonstrated in FIG. 1, usually contains a pouch constructed from fabric, plastic or a similar material. It is customary for this material to be durable in order to accommodate a multitude of projectiles that may have sharp or jagged edges. On the contrary, the bands are designed to stretch, so the material must be elastic. While there are durable elastic materials, typically a pouch fabricated from leather is more durable than a rubber band.

In the case of the current invention, it is advantageous to produce pouch 12 and bands 14 as a single part because it allows wristband slingshot 20 to be molded as a single part. While the elastic material is not as durable as leather, it is more than capable of enduring the same function as a separate pouch. Using this method greatly reduces costs by removing any cost associated with assembly and only molding one part. Also, once the mold is made, the cost of manufacturing additional units is relatively smaller. Any benefits obtained by fabricating the pouch as a separate, sturdier material are offset by the significant increase in cost that would be conceded due to this action.

The defining difference between the preferred embodiment of the wristband slingshot and a typical prior art slingshot is the base of the wristband slingshot is the user's hand, not something the user holds. The user's hand contains first digit and second digit. These digits act as members of the fork, replacing the need for a base. By incorporating the user's hand as a fundamental element of the device, the current invention reduces costs and increases the versatility of the invention. This is discussed in further detail in the subsequent text.

In addition to the main features of wristband slingshot 20 shown in FIG. 2, some other important features are demonstrated. Preferably, ridges 22 are located along pouch 12 to assist in holding and gripping projectiles. When band 14 is stretched, ridges 22 engage the projectile in such a way that urges the projectile to remain in pouch 12. Wristband slingshot 20 has finger holes 24 at each end of the invention. Finger holes 24 fit over the first and second digits of a user's hand. The top left corner of FIG. 2 shows protruded region 26, which is used for the clasping mechanism of the invention. This is discussed further in the succeeding text.

Each finger hole 24 is designed to allow enough space to fit over any digit of a user's hand. Preferably, the length of the total band 14 is about 2-3 times the length of the pouch. This allows enough area for a moderately sized projectile to fit in pouch 12 while still allowing enough of a reduced area for band 14 to stretch a desired amount. Also, this enables the overall length of wristband slingshot 20 to be convenient for all users despite age or size. It is important to note that there is no concern of wristband slingshot 20 being too long to fit a user's hand. If the overall distance between the user's index finger and thumb is small, then wristband slingshot 20 will be capable of stretching a larger distance.

The elevation view shown in FIG. 3 illustrates a few important features of the preferred embodiment of wristband slingshot 20. The increased cross sectional area region of wristband slingshot 20, indicated by the pouch 12, is approximately double the height of band region 14 in the current view. Even though pouch 12 is shown to be about double the height (in the current view) of band 14, this should not be taken as limiting the thickness of the pouch or bands. Rather, the preferred embodiment of the invention has a region of increased area (pouch 12) that allows wristband slingshot 20 to hold a projectile more effectively. Changing the relative thickness of pouch 12 and band 14 is easily accomplished.

FIG. 3 shows pouch center hole 28 in the center of pouch 12. Pouch center hole 28 is used to position a projectile (especially a projectile that is round in shape) at the center of pouch 12. Correct alignment of the projectile is essential for accurate aim. While ridges 22 are shown to be centered about and equidistant from pouch center hole 28, the position of these ridges can vary depending on the intended projectile to be used.

In the view in FIG. 3, the left hand side of the drawing contains protruded region 26 extended from finger hole 24. This end of wristband slingshot 20 is referred to as the protruded end of the invention and the other side (right hand side in the current view) will be referred to as the receiving end of the invention. The receiving end is labeled as such because it accepts or receives the protruded region 26 when wristband slingshot 20 is in a closed state for the clasping mechanism. The outer diameter of the protruded region 26 is given by $d_p$ 30. The inner diameter of the receiving end for the clasping mechanism is given by $d_r$ 32.

The inner diameter of finger hole 24 on the receiving end (also $d_r$ 32) has a larger diameter than the inner diameter of finger hole 24 on the protruded end for the clasping mechanism. In order for the clasping portion of the invention to function properly, the outer diameter of the protruded end ($d_p$ 30) must fit into the inner diameter of the receiving end ($d_r$ 32). Since both diameters are features of finger holes 24, the diameters of the finger holes must also reflect the difference in diameter.

Figure 4:
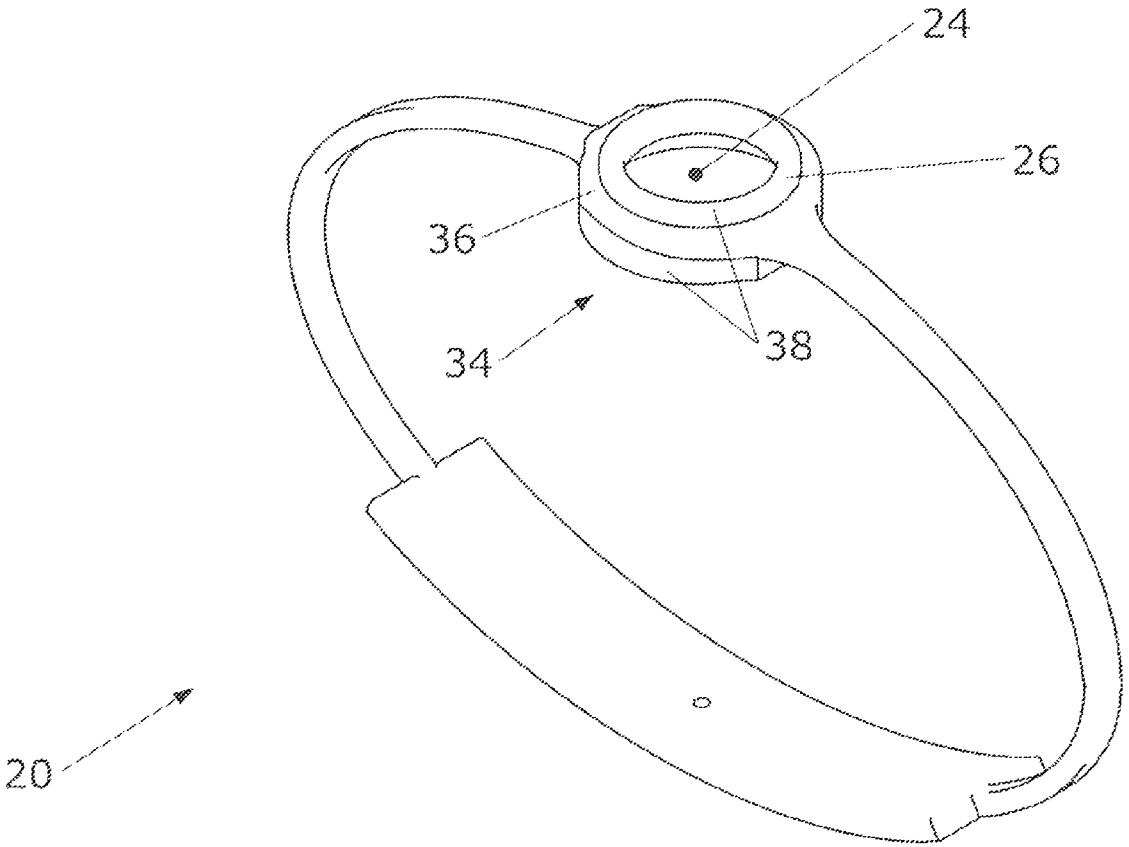
FIG. 4 is a perspective view, showing a preferred embodiment of the current invention with the clasping mechanism in a closed state.

A preferred embodiment of wristband slingshot 20 with the clasping mechanism in a closed state in order to be worn as a wristband is shown in FIG. 4. The transition of wristband slingshot 20 from the configuration shown in FIGS. 2-3 and the configuration shown in FIG. 4 is easily accomplished. As was discussed briefly in the preceding text, the clasping mechanism 34 is fastened by inserting protruded region 26 (shown in FIG. 2) into finger hole 24 on the receiving end of the invention. Once this operation has been completed, clasping mechanism 34 holds wristband slingshot 20 together, creating a wristband.

As those skilled in the art know, in order for the clasping mechanism to function properly, careful consideration must be taken when determining the diameters $d_p$ and $d_r$. In a preferred embodiment of the current invention, the diameter of the protruded region, $d_p$ 30 is approximately equal (slightly smaller) to the diameter of the finger hole on the receiving end, $d_r$ 32 everywhere except for the upper portion of the protruded end. By referring to FIG. 4, the reader can see that a portion of protruded region 26 sticks out past finger hole 24 on the receiving end. The diameter of this portion of protruded region 26 is slightly greater than the diameter of the remaining portion of protruded region 26. In other words, $d_p$ is slightly larger than $d_r$ near the upper region of protruded region 26 in order to hold the wristband slingshot together. FIG. 4 shows protruded region 26 slightly overlapping the outer portion of the finger hole from receiving end 36.

Clasping mechanism 34 works for a few reasons. First, the material of the wristband slingshot is preferably soft so it is not difficult to force the larger diameter portion of $d_p$ into $d_r$. Second, once the larger diameter is through $d_r$, the larger region expands over the finger hole on the receiving end 36 of wristband slingshot 20. This "locks" the wristband together. Although clasping mechanism 34 "locks" the wristband together, it does not hold it so tightly that it is difficult for a user to unclasp the wristband slingshot. Finally, even though the clasping mechanism holds the wristband slingshot together, the invention is still easily unclasped. This is advantageous in the event a user needs to use the slingshot component quickly—for hunting in the case of an outdoorsman or an ambush in the case of a children's game.

The capability of the present invention to act as a wristband, in addition to a slingshot or other mechanism, allows the invention to be stowed easily and quickly. Similarly, the wristband is easily and quickly removed in order to be used with little delay, if necessary. As discussed briefly in the preceding text, this is useful in many situations. For example, a camper or hiker who unexpectedly stumbles upon game to be hunted has immediate access to the present invention on the user's wrist. In addition, this is useful in a children's game where both hands are needed while the slingshot is not in immediate use. As an example, children playing a chase or war game may require both hands to climb a tree, jump over a fence, or perform a number of other activities. The opportunities presented here are not possible when using a prior art slingshot (shown in FIG. 1)—the user would need to be carrying the prior art slingshot in order to have the same accessibility presented with the current invention.

Figure 5:
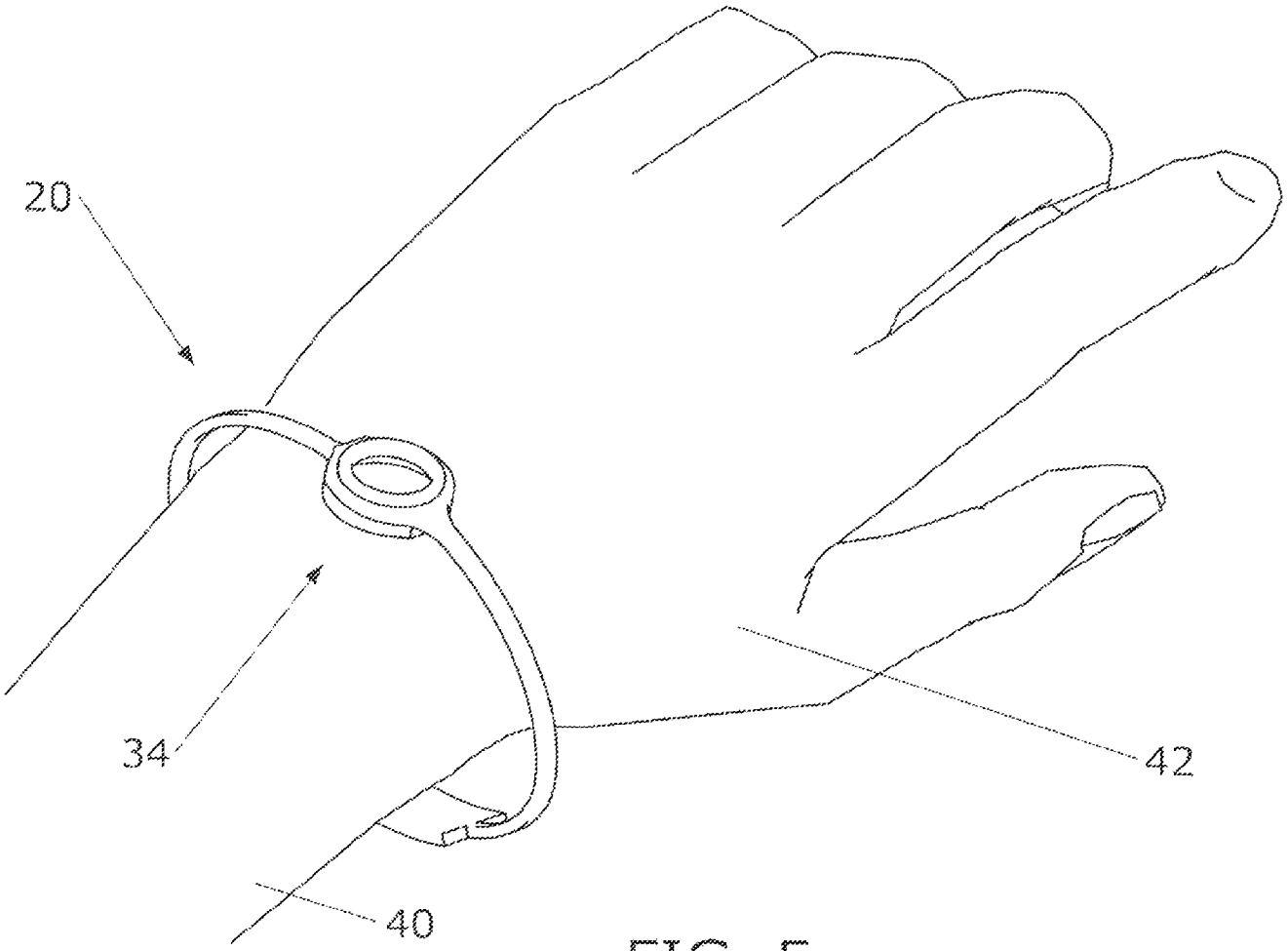
FIG. 5 is a perspective view, showing the current invention with the clasping mechanism in a closed state worn on a user's wrist.

FIG. 5 shows a perspective view of wristband slingshot 20 on a user's wrist. Typically, the user would fasten clasping mechanism 34 after wristband slingshot 20 is on the user's arm 40 (similar to a watch or clasping bracelet). If the user's hand is small enough, it is possible to fasten clasping mechanism 34 before wristband slingshot 20 is on the user's arm 40, and then slide the invention over user's hand 42. A preferred embodiment of wristband slingshot 20 is designed to fit loosely on the user's arm 40. If wristband slingshot 20 is too tight, the user may find it difficult to fasten or unfasten the wristband configuration.

Figure 6:
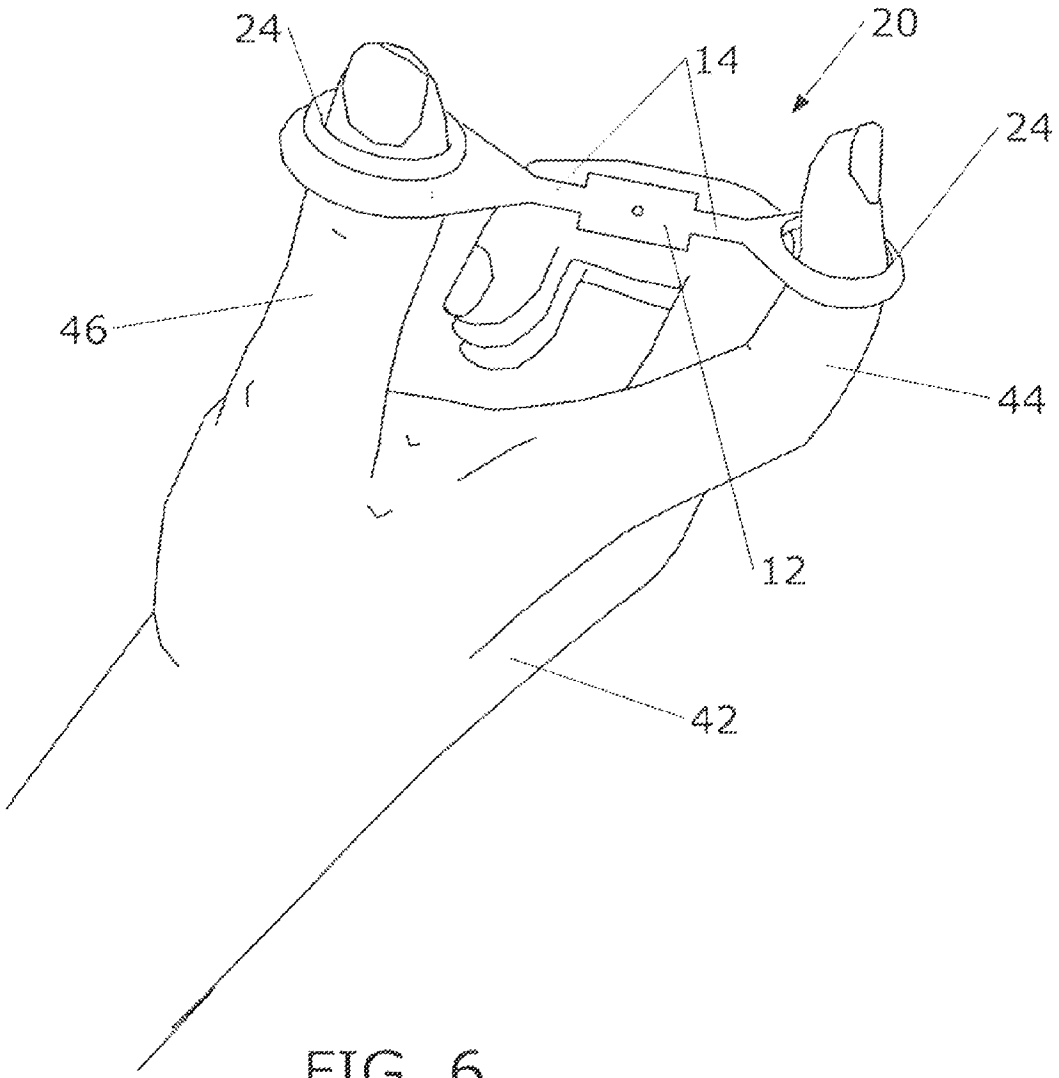
FIG. 6 is a perspective view, showing the present invention in a relaxed state on a user's fingers.

While FIG. 5 shows the application of the current invention as a wristband, FIG. 6 shows the application of the wristband slingshot to be used to launch a projectile. FIG. 6 shows wristband slingshot 20 stretched between the user's fingers. In the preferred embodiment of the invention, one digit of the user's hand (for example, the user's thumb 44) fits into one finger hole 24 of the invention, and a second digit of the user's hand (such as, the user's index finger 46) fits into the other finger hole 24 of the wristband slingshot.

Comparing the prior art slingshot from FIG. 1 to wristband slingshot 20 in FIG. 6 allows the reader to see how the components of a conventional slingshot are similar to and different from wristband slingshot 20. Both slingshots contain at least one band 14 fastened to each member of the fork in some manner. Commonly, a prior art slingshot will have two bands separated by pouch 12. Bach band 14 is fastened to each member of fork 18 on one end and pouch 12 on the other end (as described in the preceding text). Alternatively, pouch 12 and band 14 can be a singular element. This is the case for wristband slingshot 20 and some prior art slingshots.

The main difference between the current invention and a prior art slingshot is the base. A prior art slingshot commonly uses a sturdy structure as a base, such as a forked stick or a manufactured piece of plastic. The current invention uses the user's hand 42 as the base for the slingshot. This amounts to a significant decrease in storage space required for the slingshot. The base is the main element that occupies space for a typical prior art slingshot (FIG. 1). Replacing the base with the user's hand essentially eliminates any space required to stow the slingshot. This does not even take into account the fact that the invention acts also as a wristband.

Instead of members of a fork, band 14 is fastened to the user's index finger 46 and thumb 44 by placing the two fingers through finger holes 24. The user's fingers act as the two members of the fork while the user's arm 42 acts as the base for the slingshot. In addition to the storage advantage listed above, there is another benefit from using one's arm as the base for a slingshot. It is more natural for a user to resist the force created when loading and aiming a projectile with his or her arm and hand than it is while gripping a stick or member as is done with a typical prior art slingshot. This is why many newer slingshots come with a support lever that rests against the user's forearm. The support gives the user leverage over the slingshot that was lost due to the length of the base.

Figure 7:
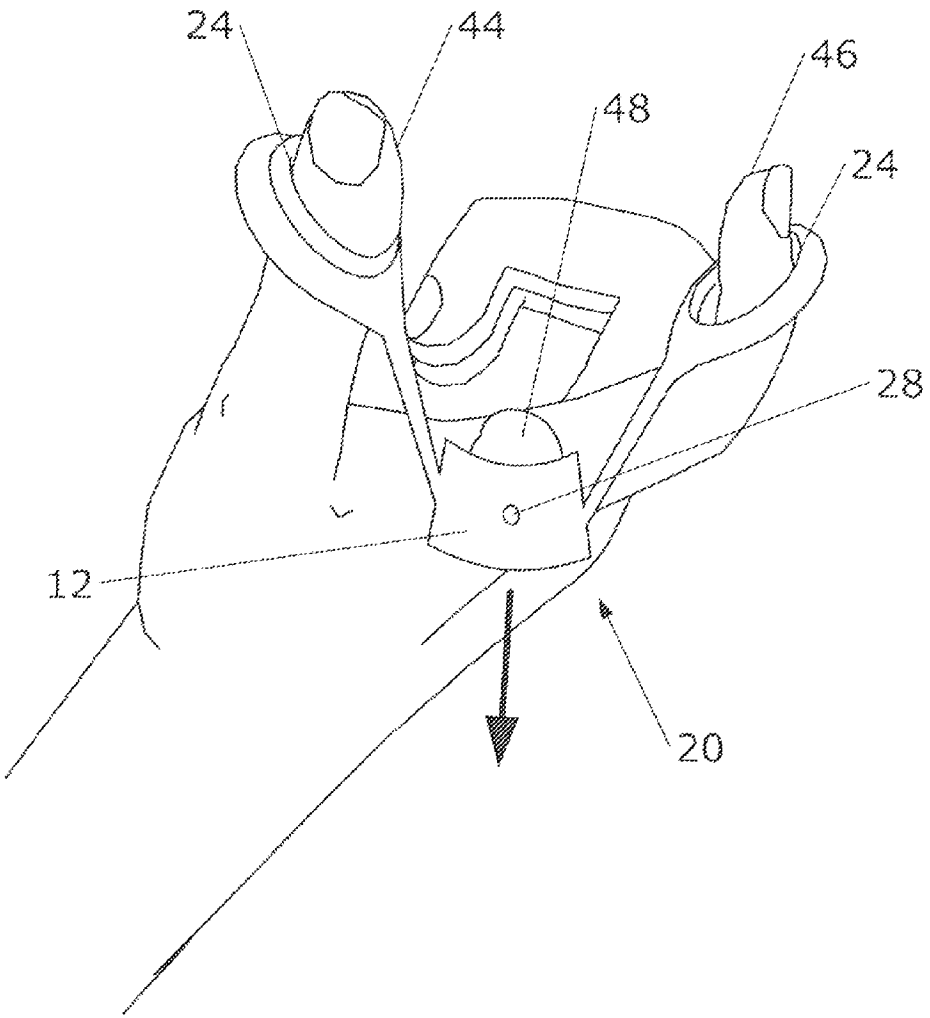
FIG. 7 is a perspective view, showing the current invention in a stretched slate, preparing to launch a projectile.

Once wristband slingshot 20 is properly attached to the members of the user's hand, as it is in FIG. 6, the user can proceed to loading a projectile. FIG. 7 demonstrates wristband slingshot 20 loaded with projectile 48. The user places projectile 48 in pouch 12 using pouch center hole 28 to center projectile 48 in pouch 12. As the user pulls projectile 48 and pouch 12 in the direction of the arrow, which is the direction of pulling force 50, band 14 stretches. By continuing to stretch band 14, the user increases the force and velocity at which projectile 48 will travel. The amount a user can stretch band 14 depends on the strength of the user and the distance between the digits used on the user's hand.

After the user has extended projectile 48 and pouch 12 sufficiently, he or she aims projectile 48 at the intended target. Once pouch 12 is released projectile 48 is launched. It is important that the user place his or her fingers far enough into finger holes 24. If the user's fingers are not far enough into finger holes 24, there is a chance that when projectile 48 and pouch 12 are released wristband slingshot 20 will fly off of the user's hand. Apart from losing one's wristband slingshot, this could also interrupt the intended trajectory of the projectile.

Figure 8:
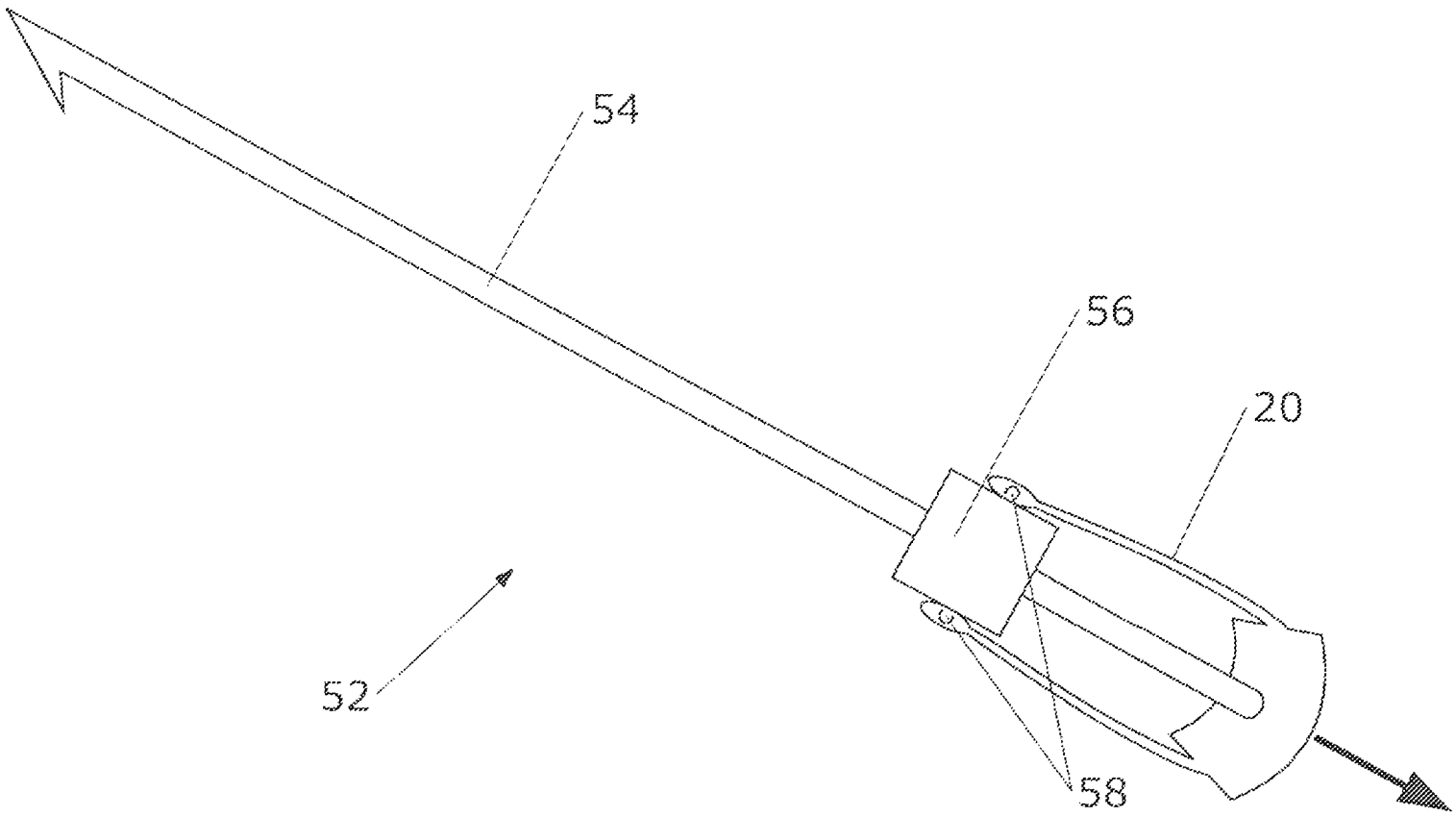
FIG. 8 is a perspective view, showing the present invention used as the elastic component of a spear fishing device.

In addition to using wristband slingshot 20 as a slingshot, the preferred embodiment of the current invention can be used for a multitude of applications. FIG. 8 shows one such application—wristband slingshot 20 as a component of spear fishing device 52 (commonly referred to as a Hawaiian Sling). Spear fishing device 52 comprises spear 54, guide 56, and an elastic band, such as wristband slingshot 20. Guide 56 is typically a wooden block (in a simple embodiment) with a hole through the center that guides spear 54. Additionally, guide 56 presents the user with a simple technique to stretch wristband slingshot 20 (the elastic band).

Wristband slingshot 20 attaches to opposite outer faces of guide 56. One possible embodiment (shown in FIG. 8) is for guide 56 to have two extruded knobs 58 on opposite faces of guide 56. Finger holes 24 slide over knobs 58 in order to secure wristband slingshot 20 to guide 56. To use spear fishing device 52, the user grasps guide 56 with one hand, then grasps the end of spear 54 and wristband slingshot 20 with the other hand. By pulling guide 56 and spear 54 (with the pouch portion of wristband slingshot covering the end of the spear) in opposite directions, the user "loads" spear fishing device 52. This potential energy is then transformed into kinetic energy once the user releases spear 54 and wristband slingshot 20. The force created using this method is greater than can be provided by simply throwing or thrusting spear 54 especially if the user is underwater.

Figure 9:
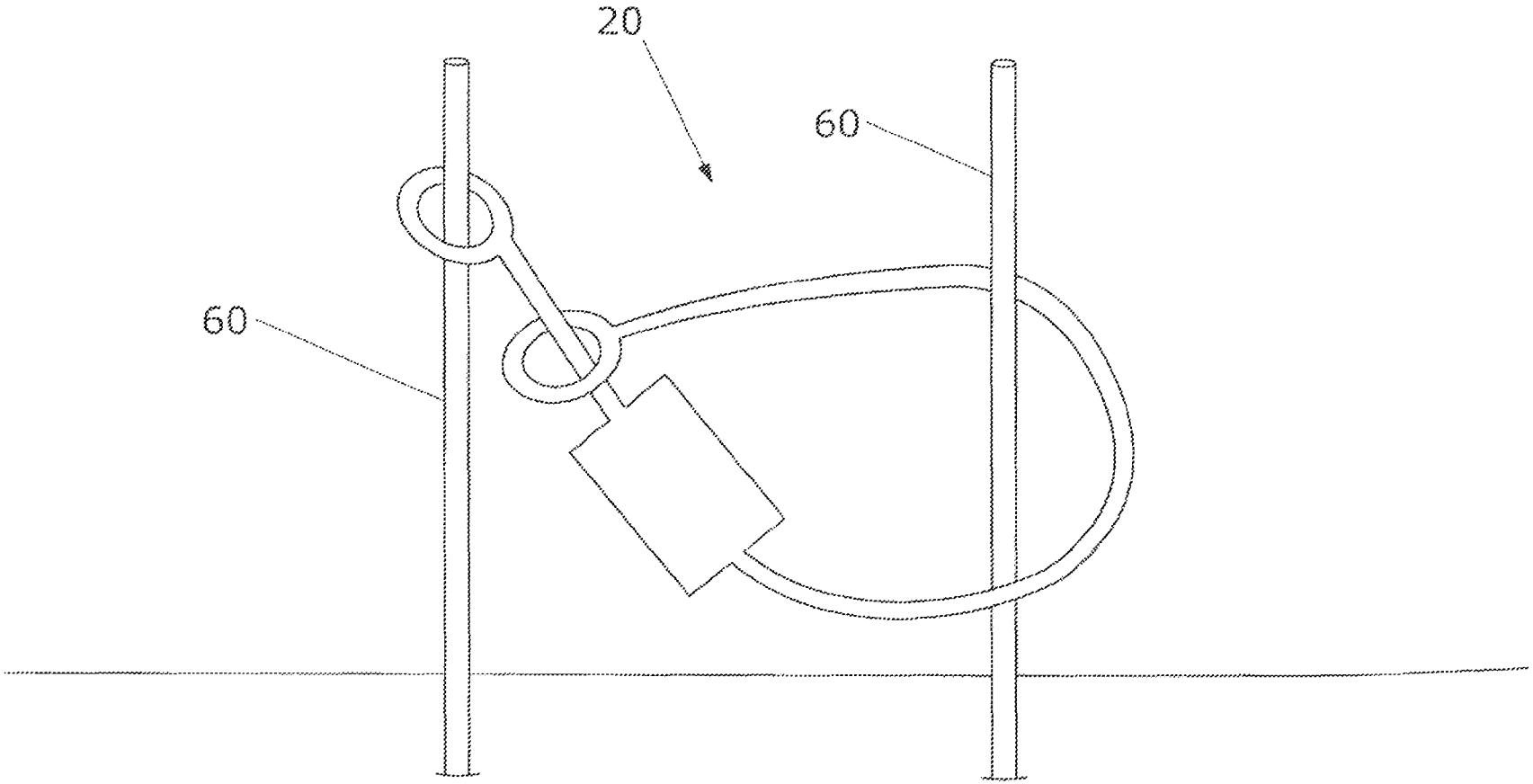
FIG. 9 is a perspective view, showing the present invention used as a snare trap.

FIG. 9 shows another alternative application of wristband slingshot 20. This application pertains to minimalist hiker or camper who hunts as a source of food while camping. FIG. 9 depicts wristband slingshot 20 as a snare trap. The snare trap shown in FIG. 9 is a simple example where wristband slingshot 20 is looped within itself and sticks 60 are used to create an opening. As those skilled in the art will be familiar there are many variations of a snare trap, but most snare traps operate in a similar manner—a small animal is attracted to the center of the trap, then when the trap is tripped the animal is trapped by the tightening of the "snare."

Figure 10:
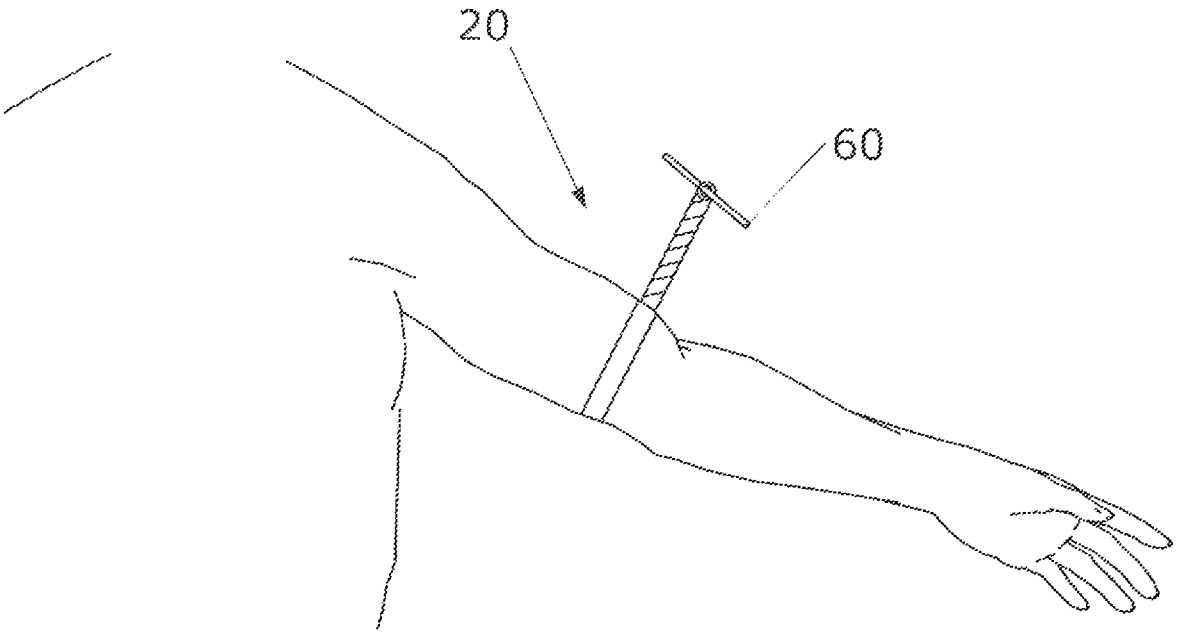
FIG. 10 is a perspective view, showing the current invention used as a tourniquet.

An additional application of wristband slingshot 20 is shown in FIG. 10. In the figure, wristband slingshot 20 is used in conjunction with stick 60 to act as a tourniquet. While hiking or camping, especially in mountainous regions, injuries are a common occurrence. Oftentimes it is important to be prepared for the worst-case-scenario. FIG. 10 demonstrates how a user can use wristband slingshot 20 even in emergency situations.

Figure 11:
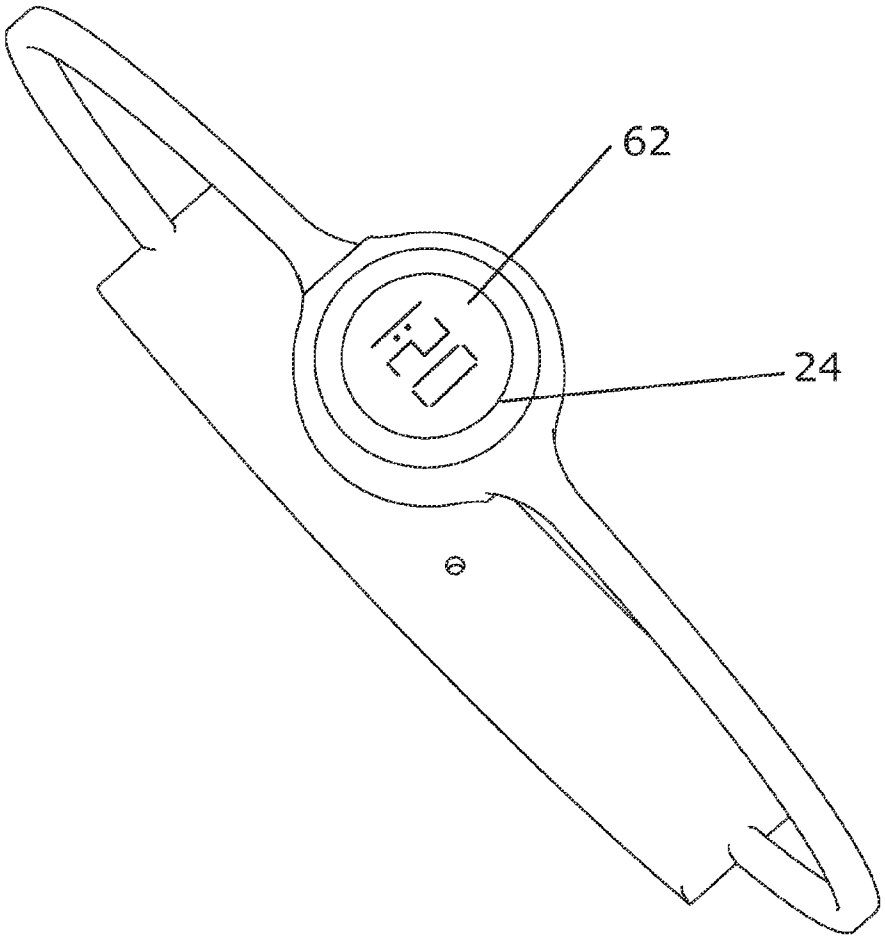
FIG. 11 is a perspective view, showing the current invention with a watch for a button inserted into the finger holes while the clasping mechanism is in a closed state.

In a preferred embodiment of the current invention, a button can be placed in the finger holes of the wristband slingshot while it is worn by the user. FIG. 11 shows button 62 inserted in finger holes 24. In this embodiment, button 62 is shown as a watch. As described in the preceding text, while camping and hiking space is very limited. Therefore, combining functions and gear is oftentimes essential to save space and weight.

Figure 12:
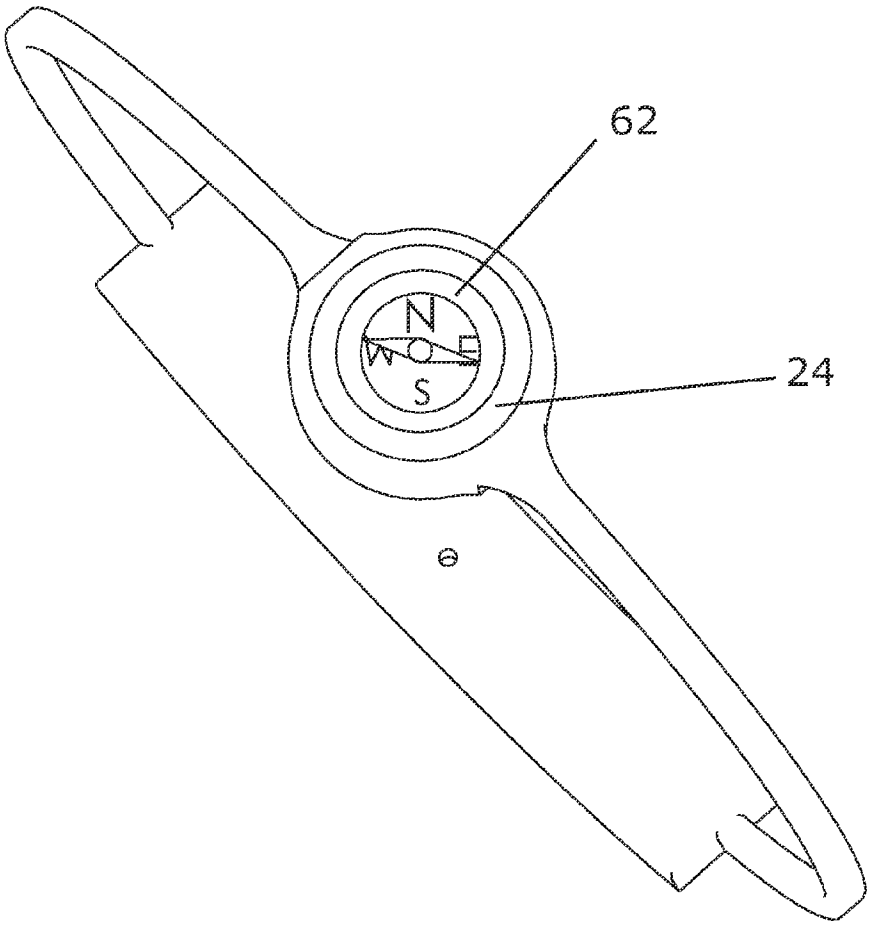
FIG. 12 is a perspective view, showing the present invention with a compass for a button inserted into the finger holes while the clasping mechanism is in a closed state.

FIG. 12 shows another possible button insert for the current invention. Button 62 takes the form of a compass in FIG. 12.

This is a very convenient configuration for a user who is hiking a long distance or someone who is camping with minimal gear. The aim of the button is to provide a convenient and easily accessible location to place a watch/compass or store emergency/survival supplies. While FIGS. 11 and 12 show two possible embodiments for the buttons inserted into the finger holes on the invention, the scope should not be limited to these two configurations. The button could contain matches, a spool of fishing line with hooks, a magnifying glass, magnesium, a folding knife, an LED flashlight, a pill box, or a combination of these components.

While the preceding description and illustrations contain significant detail regarding the novel aspects of the present invention, it should not be construed as limning the scope of the invention. Instead the specifics should be interpreted as providing examples of preferred embodiments of the invention. For example, although the clasping mechanism is described as having an increased diameter at the upper region of the protruded region (overlapping the receiving end finger hole), it is possible to incorporate another method to clasp the invention, such as a snap or thread. Such variations would not alter the function of the invention or that particular component of the invention. Thus, the scope of the invention should be fixed by the following claims, rather than the specific examples given.

Having described our invention, we claim:

1. A method allowing a slingshot to be stowed around a user's wrist and quickly removed for use in propelling a projectile, said user having a hand including a first digit and a second digit, comprising:

a. providing a wristband slingshot, including,
   i. an elastic band having a first end, a second end, and a pouch therebetween,
   ii. said first end of said elastic band opening into a first finger hole having a first diameter large enough to allow passage of said first digit,
   iii. said second end of said elastic band opening into a second finger hole having a second diameter large enough to allow passage of said second digit,
   iv. a clasping mechanism for selectively connecting and disconnecting said first end of said elastic band and said second end of said elastic band, said clasping mechanism having an open state and a closed state,
   v. wherein said first finger hole is surrounded by a first annular protrusion having a lower end connected to said elastic band and an upper end,
   vi. said upper end of said annular protrusion including an enlarged portion having a greater diameter than said second diameter of said second finger hole,
   vii. wherein said annular protrusion is configured to push through said second finger hole until said enlarged portion passes completely through said second finger hole and thereby creates a mechanical engagement between said annular protrusion and said second finger hole, whereby said first and second finger holes are aligned;

b. wrapping said elastic band around said user's wrist and closing said clasping mechanism in order to secure said elastic band to said user's wrist;

c. opening said clasping mechanism in order to separate said first end of said elastic band from said second end of said elastic band;

d. placing said first finger hole over said user's first digit;

e. placing said second finger hole over said user's second digit; and f. placing said projectile in said pouch.

2. A method for stowing and using a slingshot as recited in claim 1, wherein said pouch includes a plurality of ridges configured to grip said projectile.

3. A method for stowing and using said slingshot as recited in claim 1, wherein said pouch includes a center hole.

4. A method for stowing and using a slingshot as recited in claim 1, wherein said elastic band and said pouch are molded as one integral piece of material.

5. A method for stowing and using a slingshot as recited in claim 1, further comprising:

a. providing a button that is separate from said slingshot having an external diameter that is larger than an internal diameter of said first finger hole and said second finger hole;

b. when said clasping mechanism is in said closed state, pressing said button into said internal diameter in order to secure said button to said elastic band.

6. A method for stowing and using a slingshot as recited in claim 5, wherein said button includes a watch.

7. A method for stowing and using a slingshot as recited in claim 5, wherein said button includes a compass.

8. A method allowing a slingshot to be stowed around a user's wrist and quickly removed for use in propelling a projectile, said user having a hand including a first digit and a second digit, comprising:

a. providing a wristband slingshot, including,
   i. an elastic band having a first end, a second end, and a pouch therebetween,
   ii. a first finger hole proximate said first end of said elastic band said first finger hole having a first diameter large enough to allow passage of said first digit,
   iii. a second finger hole proximate said second end of said elastic band, said second finger hole having a second diameter large enough to allow passage of said second digit,
   iv. a clasping mechanism for selectively securing said first end of said elastic band to said second end of said elastic band,
   v. wherein said first finger hole is surrounded by a first annular protrusion having a lower end connected to said elastic band and an upper end,
   vi. said upper end of said annular protrusion including an enlarged portion having a greater diameter than said second diameter of said second finger hole,
   vii. wherein said annular protrusion is configured to push through said second finger hole until said enlarged portion passes completely through said second finger hole and thereby creates a mechanical engagement between said annular protrusion and said second finger hole, whereby said first and second finger holes are aligned;

b. wrapping said elastic band around said user's wrist and closing said clasping mechanism;

c. opening said clasping mechanism and removing said elastic band from said user's wrist;

d. placing said user's first digit through said first finger hole;

e. placing said user's second digit through said second finger hole; and f. placing said projectile in said pouch.

9. A method for stowing and using a slingshot as recited in claim 8, wherein said pouch includes a plurality of ridges configured to grip said projectile.

10. A method for stowing and using said slingshot as recited in claim 8, wherein said pouch includes a center hole.

11. A method for stowing and using a slingshot as recited in claim 8, wherein said elastic band and said pouch are molded as one integral piece of material.

12. A method for stowing and using a slingshot as recited in claim 8, further comprising:

a. providing a button that is separate from said slingshot having an external diameter that is larger than an internal diameter of said first finger hole and said second finger hole;

b. when said clasping mechanism is in said closed state, pressing said button into said internal diameter in order to secure said button to said elastic band.

13. A method for stowing and using a slingshot as recited in claim 12, wherein said button includes a watch.

14. A method for stowing and using a slingshot as recited in claim 12, wherein said button includes a compass.

* * * * *